US010960413B2

(12) United States Patent
Pacy

(10) Patent No.: US 10,960,413 B2
(45) Date of Patent: Mar. 30, 2021

(54) SEPARATOR FOR REMOVING CONTAMINANTS FROM A LIQUID BY USE OF A ROTATING CYLINDRICAL CHAMBER COMPRISING AT LEAST THREE ZONES OF DRIVE SURFACES, EACH DRIVEN BY FLUID FLOWING THROUGH THE SEPARATOR

(71) Applicant: Teresa Jeanne Hardwick Pacy, Seaview Isle of Wight (GB)

(72) Inventor: Mark Richard Hardwick Pacy, Seaview (GB)

( * ) Notice: Subject to any disclaimer, the term of this patent is extended or adjusted under 35 U.S.C. 154(b) by 0 days.

(21) Appl. No.: 15/772,055

(22) PCT Filed: Nov. 2, 2016

(86) PCT No.: PCT/GB2016/053400
§ 371 (c)(1),
(2) Date: Apr. 28, 2018

(87) PCT Pub. No.: WO2017/077294
PCT Pub. Date: May 11, 2017

(65) Prior Publication Data

US 2018/0236461 A1 Aug. 23, 2018

(30) Foreign Application Priority Data

Nov. 2, 2015 (GB) ..... 1519346

(51) Int. Cl.
*B04B 15/06* (2006.01)
*B04B 1/08* (2006.01)
(Continued)

(52) U.S. Cl.
CPC ..... *B04B 15/06* (2013.01); *B04B 1/08* (2013.01); *B04B 3/00* (2013.01); *B04B 5/005* (2013.01);
(Continued)

(58) Field of Classification Search
CPC ..... B04B 11/043; B04B 7/06; B04B 13/00; B04B 5/005; B04B 11/04; B04B 9/10;
(Continued)

(56) References Cited

U.S. PATENT DOCUMENTS 6,019,717 A * 2/2000 Herman ..... B04B 1/08 210/167.02
6,294,091 B1 * 9/2001 Hoff ..... B04B 1/02 210/295

(Continued)

FOREIGN PATENT DOCUMENTS

WO 2018/148678 A1 * 8/2018

*Primary Examiner* — Charles Cooley
(74) *Attorney, Agent, or Firm* — Henry E Naylor

(57) ABSTRACT

A separator for removing contaminants from a circulating liquid, preferably a contaminated oil, by use of centrifugal motion wherein a cylindrical chamber is mounted about a spindle serving as an axis of rotation. In-flowing contaminated liquid to be treated enters the cylindrical chamber and the base of said chamber and is directed onto distribution disk wherein it impacts a plurality of drive surfaces that impart a first source of rotational motion to said chamber. The in-flowing oil to be treated is directed against the inner wall of the cylindrical chamber, thus causing contaminant to adhere to the inner wall. As the thickness of contaminant increases on the inner wall of the chamber, the rotational speed of the chamber is reduced until it reaches a predetermined threshold speed causing a sensor to activate a signal indicating that the separator needs to be cleaned of contaminant. There is also provided a porous material at the exit where treated liquid exits and which, after a period of time, will become blocked and thus also acting to slow the rotational speed of the chamber.

8 Claims, 7 Drawing Sheets

(51) Int. Cl.

| | |
|---|---|
| ***B04B 5/00*** | (2006.01) |
| ***B04B 9/06*** | (2006.01) |
| ***B04B 11/06*** | (2006.01) |
| ***B04B 13/00*** | (2006.01) |
| ***B04B 3/00*** | (2006.01) |
| ***B04B 11/02*** | (2006.01) |
| ***B04B 11/04*** | (2006.01) |

(52) U.S. Cl.
CPC ..... *B04B 9/06* (2013.01); *B04B 11/02* (2013.01); *B04B 11/043* (2013.01); *B04B 11/06* (2013.01); *B04B 13/00* (2013.01)

(58) Field of Classification Search
CPC .. B04B 9/06; B04B 15/06; B04B 3/00; B04B 11/02; B04B 11/06; B04B 1/08
USPC ..... 494/49
See application file for complete search history.

(56) References Cited

U.S. PATENT DOCUMENTS

| | | | | |
|---|---|---|---|---|
| 6,572,523 | B2 * | 6/2003 | Herman | B04B 5/005 116/202 |
| 6,929,596 | B2 * | 8/2005 | Amirkhanian | B04B 5/005 494/49 |
| 7,338,426 | B2 * | 3/2008 | Samways | B04B 5/005 494/10 |
| 2002/0147096 | A1 * | 10/2002 | Herman | B04B 5/005 494/10 |
| 2003/0078152 | A1 * | 4/2003 | Fischer | B04B 5/005 494/10 |
| 2004/0023782 | A1 * | 2/2004 | Herman | B04B 1/08 494/49 |
| 2018/0029047 | A1 * | 2/2018 | Burford | |
| 2018/0236461 | A1 * | 8/2018 | Pacy | |
| 2019/0224690 | A1 * | 7/2019 | Birk | B04B 5/005 |
| 2019/0247864 | A1 * | 8/2019 | Wu | B01D 33/11 |

* cited by examiner

SEPARATOR FOR REMOVING CONTAMINANTS FROM A LIQUID BY USE OF A ROTATING CYLINDRICAL CHAMBER COMPRISING AT LEAST THREE ZONES OF DRIVE SURFACES, EACH DRIVEN BY FLUID FLOWING THROUGH THE SEPARATOR

The present application is the U.S. National Phase of International Patent Application Serial No. PCT/GB2016/053400, filed Nov. 2, 2016, which claims priority to GB Application Serial No. 1519346.9, filed Nov. 2, 2015.

TECHNICAL FIELD

The present invention relates to liquid separators, and in particular, although not exclusively to oil separators.

BACKGROUND

Oil separators are known for systems or machinery in which a quantity of oil is forced around moving parts. Inevitably, in serving its purpose to lubricate the moving parts various debris and contaminants will become entrained in the oil. It is important for the oil to do its job and ensure optimum operational conditions, that as higher quantity of the contaminants are removed as possible. Known oil separators perform this task by the application subjecting the oil to a centrifugal force within a vessel, the unwanted material is held within the vessel of the separator and clean oil is output to be returned back to the host system. However, we have realised that known oil separators are not as efficient in removing contaminants as would be preferred. Moreover, with known oil separators when a certain level of contaminant is collected, the separation efficiency decreases significantly. However, it is difficult to know when this "saturation" or near saturation condition has occurred, without disassembling the separator and inspecting the quality of collected contaminant therein.

We seek to provide an improved liquid separator.

SUMMARY

According to a first aspect of the invention there is provided a separator for removing contaminants from a liquid, the separator comprising a rotatably mounted chamber arranged to rotate about an axis of rotation, and the separator further comprising an inlet for liquid to enter the chamber and an outlet for liquid to leave the chamber, and the inlet is at a greater radial position from the axis of rotation as compared to the outlet, and further wherein the flow of liquid into the chamber arranged to cause the chamber to rotate, and a thickness of contaminant sludge cake caused to accumulate on an inner wall of the chamber.

The separator may comprise a rotational speed sensor which is arranged to sense the speed of rotation of the chamber. The separator may comprise an alert signal generator, arranged to issue an alert signal if the rotational speed of the chamber is determined to have fallen (or reached or passed a threshold value) below a predetermined threshold speed. The threshold speed is preferably indicative of a predetermined thickness of sludge having accumulated on the inner wall.

The speed sensor may comprise one part attached to the spindle, or other support surface which shares the same inertial frame of reference as the spindle, and a second part which is attached to the chamber.

The inner wall of the chamber is preferably substantially cylindrical.

The chamber inlet is preferably the, or those, regions where the liquid enters the chamber. The chamber outlet is preferably the, or those, regions where liquid exits the chamber.

The inlet may comprise a plurality of channels into the chamber.

The chamber may comprise multiple drive surfaces arranged, when impacted by the inflowing liquid, to impart a turning moment and to thereby rotate to the chamber.

The drive surfaces may be termed an impeller or a turbine drive. The drive surfaces may comprise multiple fins or vanes.

Each drive surface is preferably curved or of varying gradient, or multi-radiussed, when viewed in plan. The drive surfaces may be of substantially (part-) spiral shape.

The drive surfaces are circumferentially spaced, preferably at substantially equal or regular angular intervals.

The drive surfaces may be arranged on a basal surface or in a lower region of the chamber.

Each of the operative drive surfaces may be aligned with one or more respective inlet channels.

The inlet and the outlet may be spaced in the direction of the length/height of the chamber.

The inlet may be located at a lower region of the chamber and the outlet may be located at an upper region of the chamber, or vice versa.

The drive surfaces may be radially spaced from the axis of rotation of the chamber.

The drive surfaces may be provided on respective vane formations. The separator may comprise a vane formation comprising a leading surface and a trailing surface, one of the surfaces comprises a drive surface.

The inlet to the chamber may be in fluid communication with a conduit in the spindle, wherein inflowing liquid is arranged to flow through the conduit and into the chamber through the inlet.

The separator may comprise multiple conical separators. The conical separators may comprise multiple frusto-conical formations arranged in a stack. The frusto-conical formations may have a cone angle of between 30 degrees and 50 degrees. The conical separators are preferably vertically spaced from their adjacent neighbour so as to provide a fluid channel. The conical separators are preferably provided at a central region of the chamber. A radially outermost peripheral region of the stack of the conical separators is spaced from the inner wall of the chamber. The conical separators are preferably arranged with the wider ends lowermost and the narrower ends uppermost.

The outlet may be provided at a smaller radial position as compared to the inlet.

The arrangement of the separator discs preferably prevents the liquid taking the shortest route preventing cross contamination and forces the liquid to the inner chamber (2*a*), through where the centrifugal field where force is greatest.

The chamber outlet may be in fluid communication with multiple output drive surfaces which are arranged to be impacted by the outgoing liquid to provide a rotational drive to the chamber. The output drive surfaces may be provided in a sub-chamber. The sub-chamber may be located atop the chamber. A separator liquid exit may be provided downstream of the outlet. The separator liquid exit may be provided at a greater radial position (from the central longitudinal axis of the chamber) than the chamber outlet. The separator liquid exit may provide an exit for liquid in the sub-chamber. The separator exit may comprise multiple spaced-apart openings or nozzles arranged to direct (processed) liquid externally of the separator.

According to a second aspect of the invention there is provided a liquid separator comprising a rotatably mounted chamber, the chamber comprising a number of drive surfaces, arranged, in use, to be impacted by a flow of liquid to thereby provide a driving rotation force. The separator may comprise any of the features in the preceding paragraphs, either individually or collectively.

The invention may comprise one or more features as described in the description and/or as shown in the Figures.

BRIEF DESCRIPTION OF THE DRAWINGS

Various embodiments of the invention will now be described, by way of example only, with reference to the following drawings.

DETAILED DESCRIPTION

Figure 1:
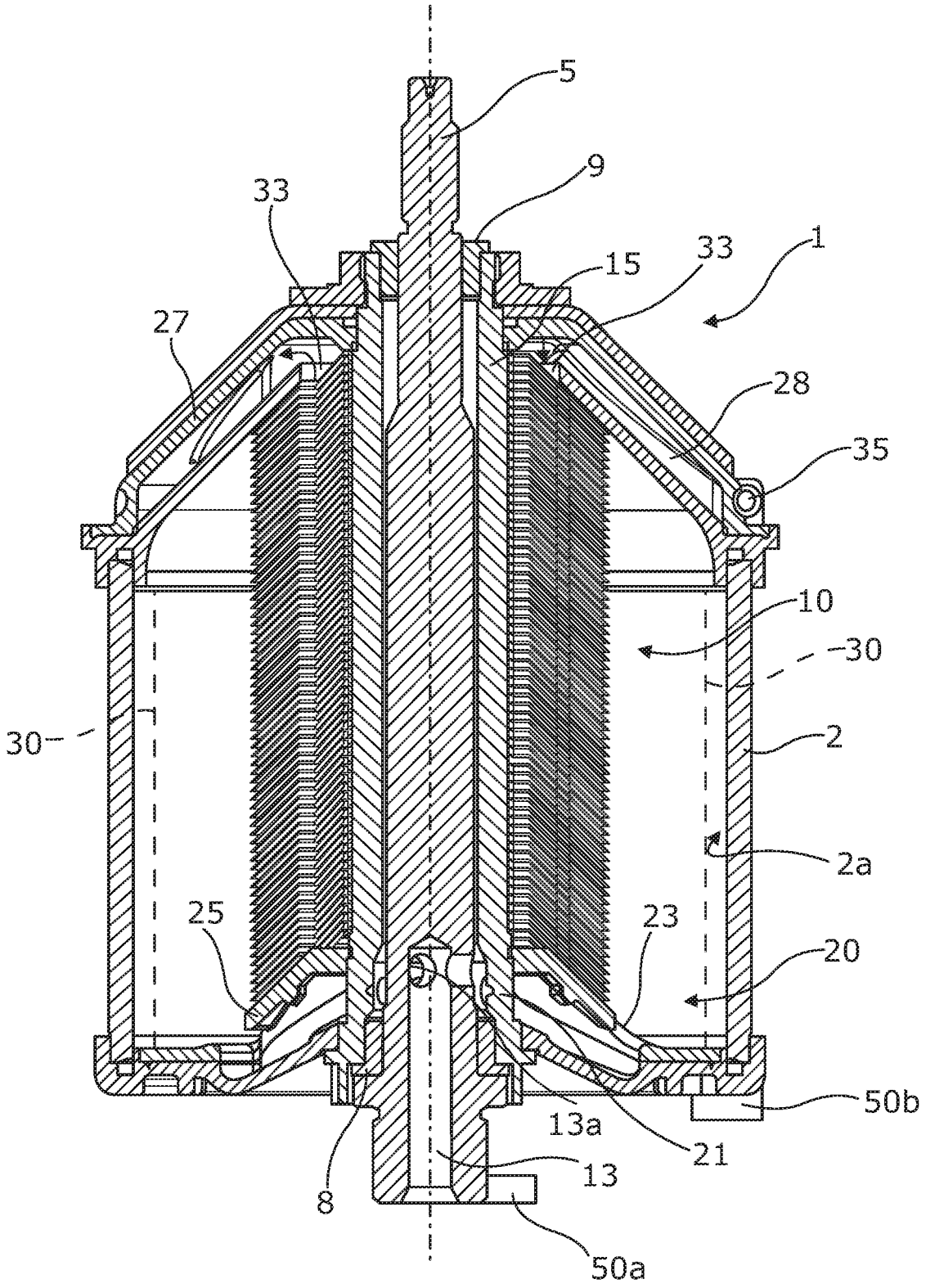
FIG. 1 is a longitudinal cross-sectional view of an oil separator.

There is now described an oil separator 1, as shown in FIG. 1. As will be described below, the separator 1 enables improved separation operational characteristics in relation to separating out contaminants in oil. The contaminants may include soot, dirt and metallic particulate, which need to be removed from an oil system to ensure optimum performance of the system.

The separator 1 comprises a generally cylindrical chamber 2, to which there is provided an inlet and an outlet. As will be described in detail below, the inlet is located at the base of the chamber, whereas the outlet is provided at the top of the chamber. In this way, all contaminated oil passes through maximum space in the generated centrifugal field before exiting. The chamber 2 is rotatably mounted about a spindle or shaft 5 by way of a top and a bottom bearing bush (referenced 8 and 9 in FIG. 1). A sleeve 15 encloses the spindle 5. Broadly, in use, the flow of oil in the chamber 2 through the inlet causes a driving force to be applied to the chamber, so as to rotate the chamber. The rotational motion of the chamber brings about a centrifugal effect to the liquid within the chamber, such that the contaminants are forced towards an inner surface 2*a* of the chamber 2. A ring or annulus of sludge forms on the inner surface.

Figure 4:
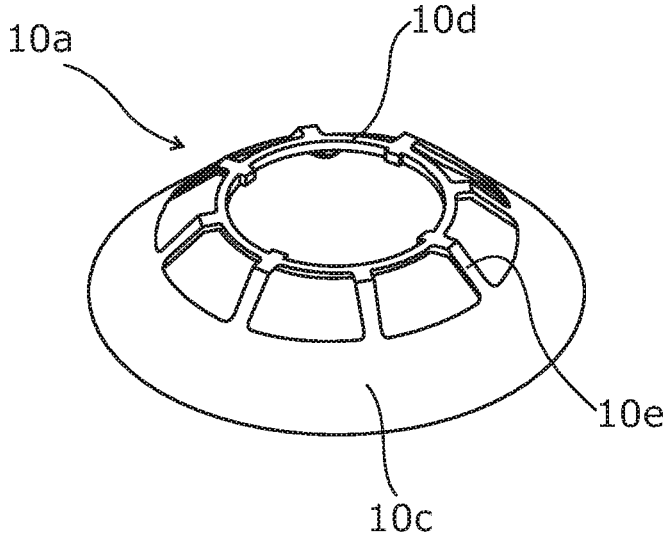
FIG. 4 is a side elevation of a separator cone, a stack of which are present in the chamber of the separator of FIG. 1.
Figure 5:
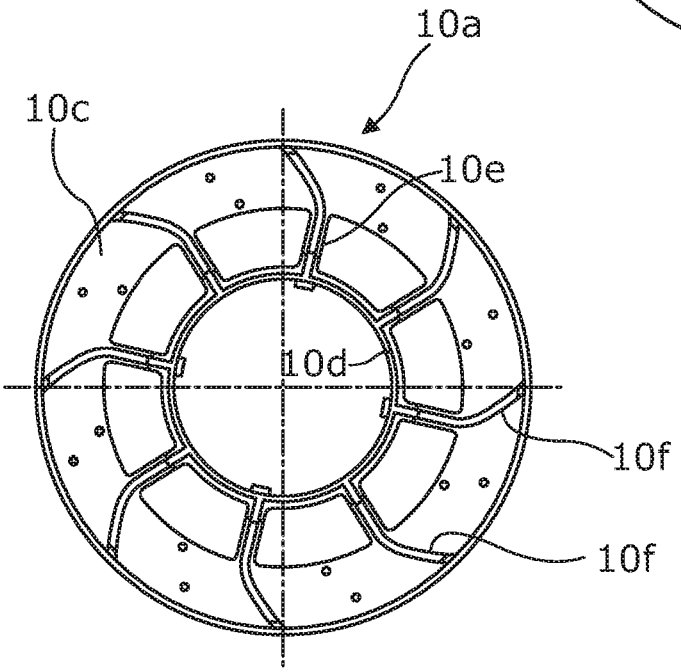
FIG. 5 is a plan view of the separator cone of FIG. 4.

Located within the chamber 2 there is provided a stack of cone or disk separators 10. The stack 10 is located centrally about the longitudinal axis of chamber 2, and each disk separator is maintained vertically spaced-apart from its neighbor. This spacing of adjacent disks results in allowing for contaminants to flow out radially (when viewed in plan) outwardly, towards the inner surface 2*a* of the chamber. This inter-stack spacing is achieved by way of integrally formed features (reference 10*f*, as shown in FIG. 5) on one side of each of the disks which bears on an adjacent disk, and serves to support and maintain adjacent disks spaced apart. FIGS. 4 and 5 show views of an individual separator disk 10*a* which comprises a frusto-conical wall 10*c*, and multiples paced-apart bridging members 10*e* which connect to an uppermost rim 10*d*. The apertures between the bridging members 10*e* serve, in use, to allow processed/clean oil to flow upwardly towards the outlet within the chamber. In more detail, the inter-stack spacing formations 10*f* are circumferentially distributed about the discs 10*a*. The radiused end portions of the formations 10*f* serve to assist in contributing to the centrifugal effect, by way of oil impacting on the formations 10*f*. The stack 10 of discs is held fast with respect to the inertial frame of reference of the chamber 2.

Figure 2:
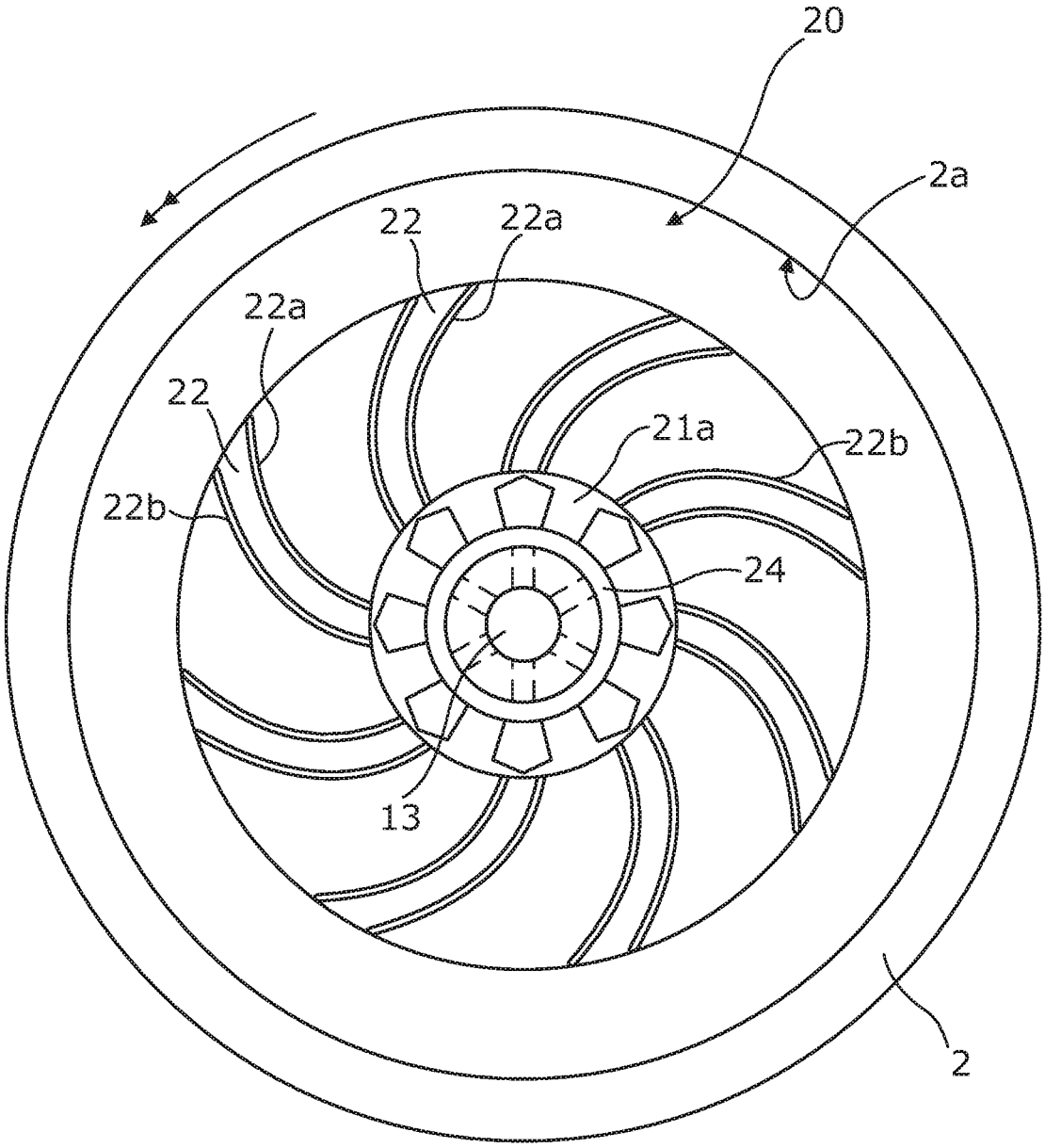
FIG. 2 is a sectional downward plan view, inside the chamber of the separator of FIG. 1.

Details of the inlet portion of the separator are now described, referring in particular to FIGS. 1 and 2. A basal portion of the chamber comprises distributor 20 (which may be termed a distributor ring). Broadly, the distributor 20 serves to distribute incoming (unprocessed) liquid in the chamber, as well as providing drive surfaces which bring about rotation of the chamber. There is provided a hub portion 21 which defines therein multiple (feed) channels 21*a*, separate from each other. The channels 21*a* are substantially radially located. Liquid reaches the orifices by way of flowing through a conduit 13 which is provided in a lower portion of the spindle 5. An upper portion of the conduit 13 is provided with multiple ports 23. The ports 23 are fluidically connected to an annular space 24, which in turn is fluidically connected to the channels 21*a*. Each channel leads to a respective drive surface 22*a*, as best seen in FIG. 2. Each drive surface 22*a*, when viewed in plan, is of curved or multi-radiussed shape. Moreover, the shape may be viewed as part spiral. The shaping of the drive surfaces is such that when liquid impacts on the surface, it causes a turning moment to be applied to the chamber. The drive surfaces 22*a* may be considered in this way as serving as vanes similar to that of a turbine drive. Each drive surface 22*a* is a surface of a rib or vane formation 22. The formations 22 are equally angularly spaced from one another, and form channels therebetween. The formations 22 are provided on a basal surface of the chamber 2.

Figure 3:
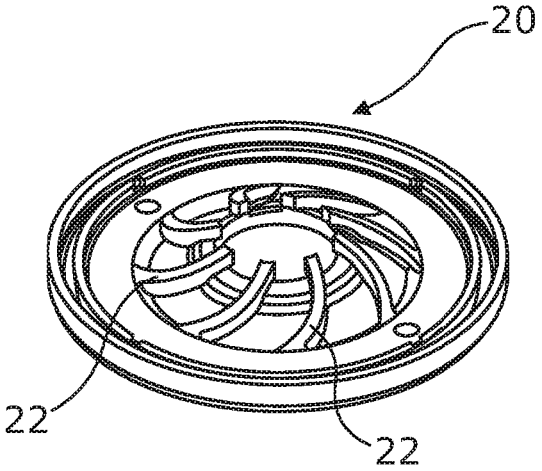
FIG. 3 is a perspective view of a vaned distributor of the oil separator.

The shaping and configuration of the vane formations 22 also assists liquid to towards the inner wall 2*a* of the chamber, and thereby enhances the centrifugal effect. The formations 22 can more clearly be seen in FIG. 3. As can be seen, each vane formation 22 may be considered as providing a leading surface and a trailing surface. The drive surface 22*a* is the trailing surface. The surface 22*b* is similarly curved/(multi-) radiused as per the drive surface. In use the shape of the surface 22*b* serves to guide oil radially outwardly. It will be appreciated that oil is constrained within a space defined between adjacent vane formations 22.

Figure 6:
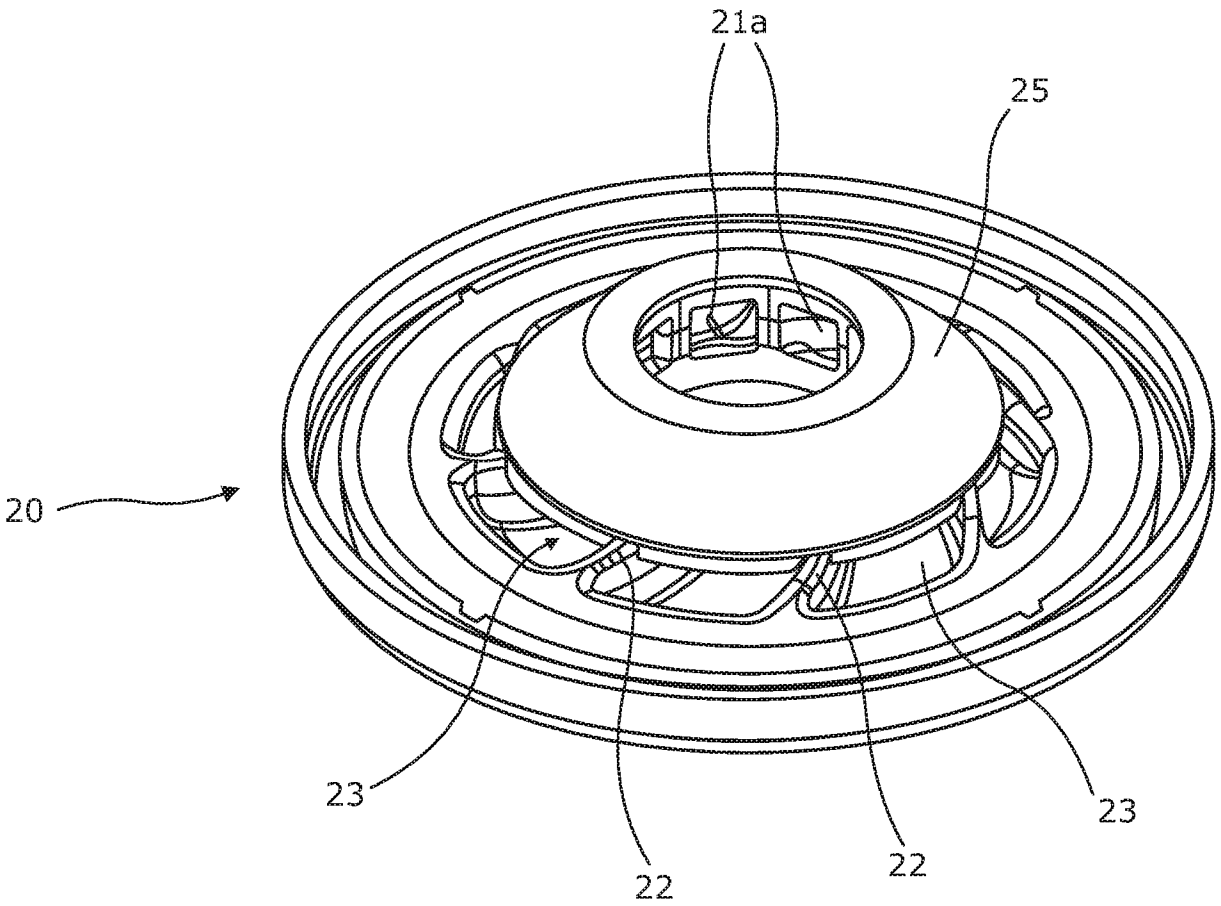
FIG. 6 is a perspective view of the distributor disc provided with a cover.

Located atop the formations 22 there is provided a cover 25. The cover is of substantially frusto-conical form, and comprises a central aperture arranged to receive the sleeve 15. The cover 25 serves in part to support the stack 10, and in part to provide and dictate a required outlet orifice (referenced 23) size and position for oil leaving the drive surfaces 24 into the chamber. The cover is best seen in FIG. 6.

In use, oil fed into the chamber 2 is forced towards the inner wall 2*a*. As the chamber progressively fills with oil it is forced upwardly through the separator discs 10*a*. The discs 10*a* provide an enhanced centrifugal separation by causing particulate to be directed radially outwardly within the spacings between adjacent discs 10*a*. That particulate accumulates with the sludge cake on the inner surface 2*a*. The oil which reaches the uppermost part of the chamber 2 reaches the chamber outlet, which is provided by a substantially annular opening. It is to be noted that the this opening occupies a smaller radial position as compared to the outlet regions adjacent the drive surfaces 24 at which oil enters the chamber. This advantageously ensures that the oil travels through the region of the chamber at which the centrifugal force is at its greatest, and thus ensuring optimal separation. In particular, the greater surface area created by the separator discs that the contaminated liquid is exposed to, causes quicker separation.

As the separation process continues, an annular sludge cake 30 accumulates on the inner wall 2*a*. The radial thickness of this sludge increases during an operational cycle. As it does so, the inertia of the chamber gradually increases, which, for the same flow rate of oil into the chamber results in a decrease in rotational speed of the chamber 2. This decrease in speed is roughly inversely proportional to the increase in thickness of the sludge cake 30. A sensor 50*a* is provided which is in a stationary frame of reference as compared to the chamber 2. A magnet 50*b* is provided attached to the chamber, and the passing proximity of the magnet is detectable by the sensor. In use, a measure of the rotational speed of the chamber can be determined. A data processor and a memory, or equivalent electronic circuitry and/or sub-assemblies, are also provided which is configured to determine from an output of the sensor 50*a* when the speed of the chamber reaches, or falls below a predetermined (stored) threshold value. This value is selected to correspond to a thickness of sludge which necessitates a service operation of the separator in which the separator is partially dissembled to allow the sludge to be removed. The data processor is connected to a visual and/or audio signalling device, which is arranged to issue an alert signal when the threshold criteria is met. For example, this may comprise a green light, amber light and a red light. The amber light is activated when the separator requires servicing due to sludge build up. A red light indicates power on.

Figure 8:
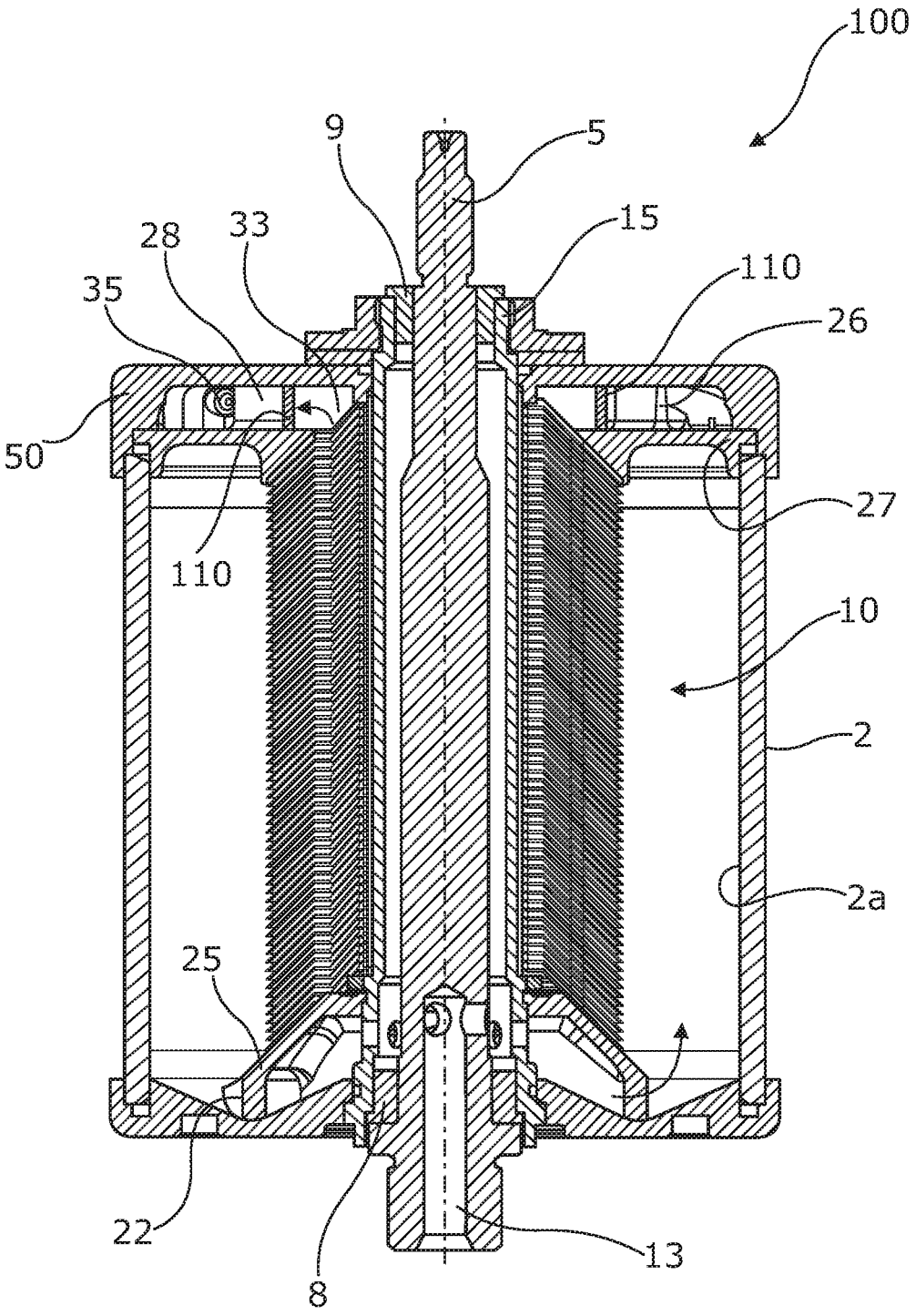
FIG. 8 is a longitudinal cross-sectional view of a second embodiment of an oil separator.

With reference to FIG. 8 there is shown a further embodiment of the invention. The separator 100 is substantially functionally identical to the separator 1, save for some structural changes. Like reference numerals are used to denote substantially the same, or identical features. One such structural change is that of the inclusion of a mesh component 110, arranged in a ring shape, located between the outlet from the chamber, and the nozzles which output cleansed oil therefrom. More generally, the mesh is located in the fluid pathway 28 between the orifice 33 from the chamber and the nozzles 35. The mesh may comprise a component of expanded or perforated metal of plastic, which comprises an array apertures/openings defined by the network-like structure of the material.

A rotational speed sensor (such as 50*a* and 50*b*) would be provided with the separator 100 (but is not shown in FIG. 8).

It will be appreciated that the separator 1 could be modified to include a similar mesh material with the pathway 28.

In use, the mesh component 110 allows liquid from the separation chamber therethrough and towards being output at the nozzles. However, over time, the apertures will gradually block with small particulate, and so progressively reducing the flow area available for fluid to flow through. This in turn has the effect of slowing the flow of fluid through the separator, and the reduction in speed can be sensed by the speed sensor. Therefore, the mesh component provides an enhancement to providing an indicator that the separator is saturated with sludge cake, and needs to be cleaned. The mesh component, may advantageously be detachable such that it can be removed from the assembly, cleaned and replaced, or alternatively, replaced with a fresh/unused mesh. The saturation level indication is thereby made more accurate.

Figure 9A:
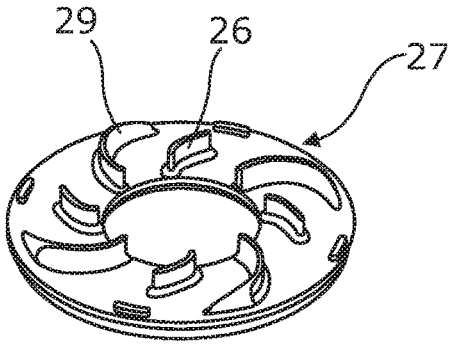
FIGS. 9A and 9B are perspective views of the uppermost sub-assemblies of the separator of FIG. 8.
Figure 9B:
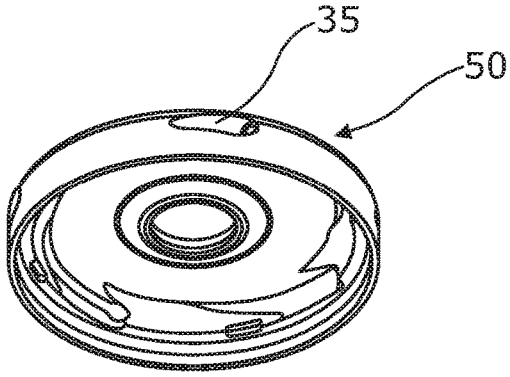
Figure 10A:
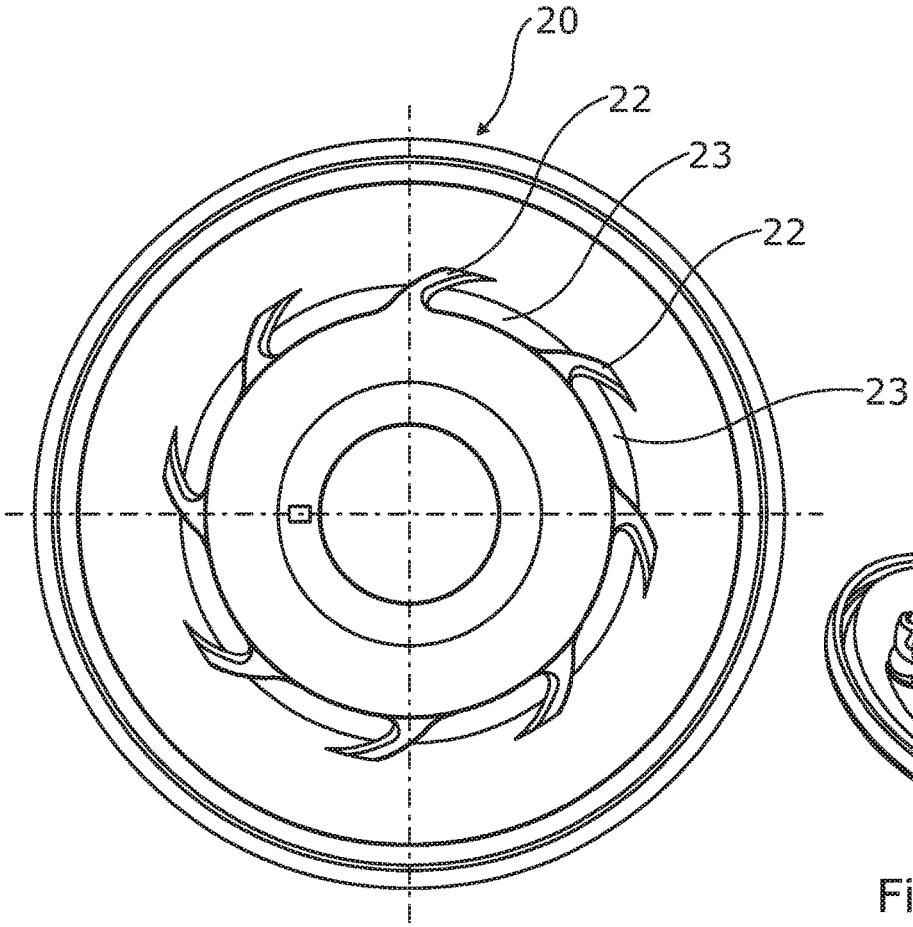
FIG. 10A is a plan view of the distributor disc component and the lower assembly of the separator of FIG. 8.
Figure 10B:
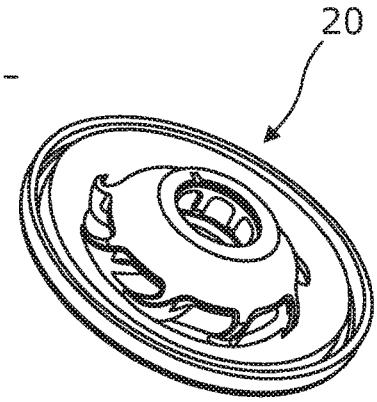
FIG. 10B is a perspective view of the distributor disc and lower separator sub-assembly.

In FIGS. 9A and 9B, and FIGS. 10A and 10B, the respective upper and lower subassemblies are shown. As can be seen, they are largely identical to those of the separator 1. In FIG. 9B, the reference numeral 50 denotes the top cover 50, which incorporates the nozzles 35.

Figure 7:
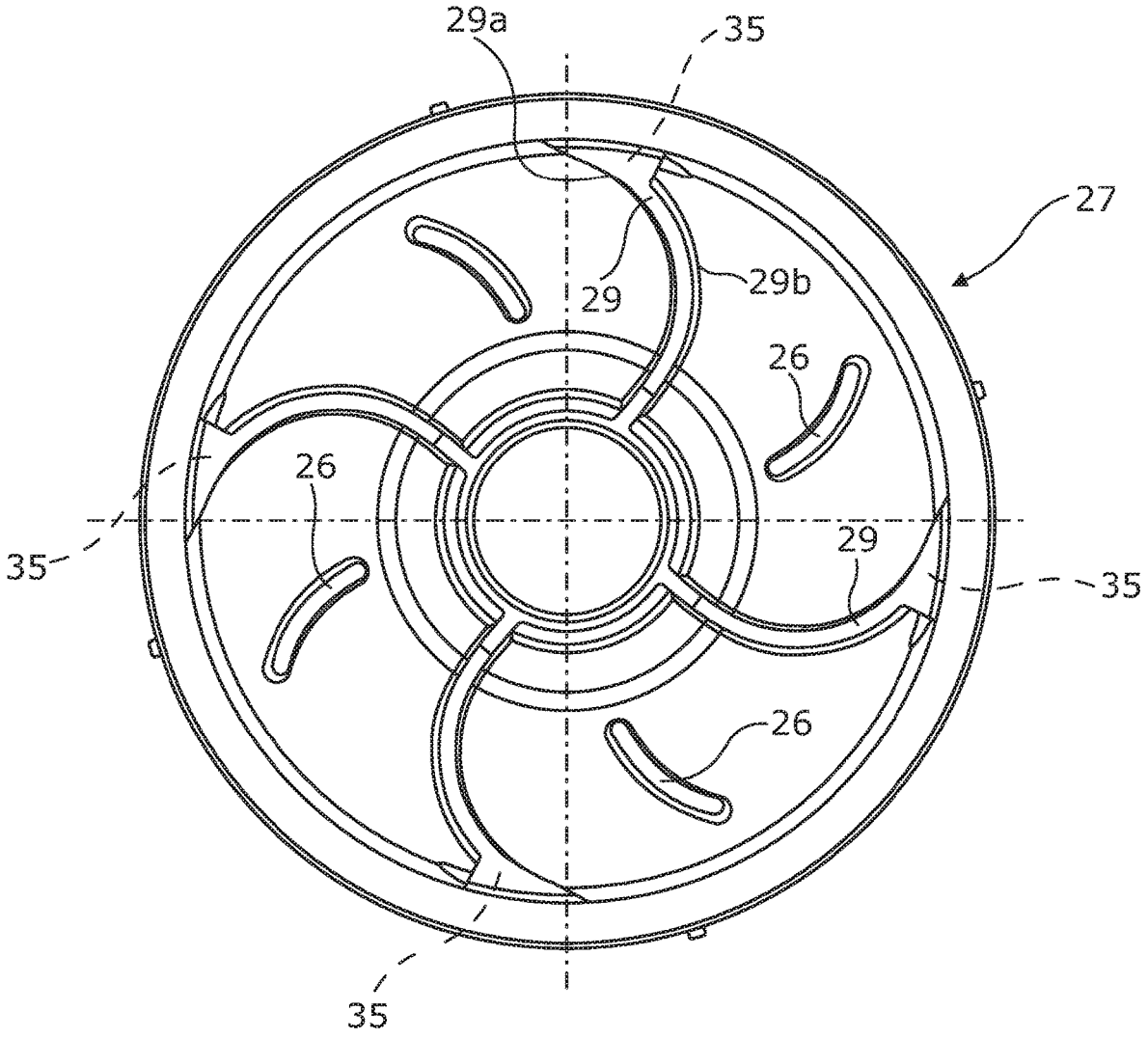
FIG. 7 is an underside view of an uppermost portion of the separator of FIG. 1.

When the (processed) oil exits the chamber it enters into sub-chamber 28, provided in an uppermost part 27 (FIG. 7) of the separator. An annular orifice 33 fluidically connects chamber 2 to sub-chamber 28. Provided within sub-chamber 28 there are provided multi-radiused drive fins/vanes 29 which upon impingement by the oil with a respective drive surface 29*a* provide a rotational motive force to chamber 2. On flowing through the sub-chamber 28, the oil is directed to one of multiple exit nozzles 35 by virtue of the oil being constrained and compartmentalized between neighboring vanes 29, as best seen in FIGS. 7 and 29A. The oil is then delivered back to the host system or machine through nozzles 35, such as an oil sump in a diesel engine. The uppermost part 27 further comprises vane formations 26 which are generally curved profile and located intermediate of vanes 29.

Advantageously, the separator 1 is capable of being driven at high rotation speeds. This results in highly effective separation of contaminants. This results from the position of the nozzles 35 at a larger diameter than the chamber inner wall 2*a*. Increased momentum also results from the design and configuration of the distributor 20 as well as the top turbine 27. The rotational sensor and alert signal advantageously means that the separator can be timely serviced only when as required. It will be appreciated that continued growth of the sludge cake would result in partial or total occlusion of the oil inlet to the chamber, resulting in restricted oil flow therethrough.

The invention claimed is:

1. A separator for removing contaminants from a circulating liquid containing contaminants, the separator comprising:

a) a rotatable cylindrical chamber having a cylindrical inner wall, which rotatable cylindrical chamber having a lower region and an upper region;

b) an inlet for accepting the flow of a liquid containing contaminants into said rotatable cylindrical chamber, which inlet is located at said lower region of said rotatable cylindrical chamber, wherein the flow of said liquid containing contaminants into said rotatable cylindrical chamber imparts a first rotational force to said rotatable cylindrical chamber, and causes a thickness of contaminant sludge cake to accumulate on said cylindrical inner wall of said rotatable cylindrical chamber when said rotatable cylindrical chamber is in rotating motion, thus resulting in a liquid having a reduced amount of contaminants when compared to liquid containing contaminants entering said rotatable cylindrical chamber;

c) at least one exit for liquid containing a reduced amount of contaminants to exit said rotatable cylindrical chamber, which at least one exit is located at said upper region of said rotatable cylindrical chamber, wherein the flow of said liquid having a reduced amount of contaminants exiting said rotatable cylindrical chamber is arranged to impart a second rotational force to said rotatable cylindrical chamber; wherein said rotatable cylindrical chamber has an axis of rotation, and rests on a circular base, which circular base has an annular hole at its center;

d) a non-rotatable spindle, representing the axis of rotation for said rotatable cylindrical chamber, said spindle being defined as a substantially cylindrically symmetric shaft having a top section that extends through the top of said separator, and a hollow bottom section that extends through said annular hole at the center of said circular base, wherein said hollow bottom section of said spindle is comprised of a hollow space surrounded by solid cylindrical walls of said spindle, within which there is provided said inlet at the base of said hollow bottom section of said non-rotatable spindle, which inlet is in fluid communication with a fluid inlet passageway represented by said hollow space of said non-rotatable spindle, which hollow space extending upward within said non-rotatable spindle to a section of said spindle where there is located at least one inlet port positioned through said solid cylindrical wall of said non-rotatable spindle, which said at least one port is in fluid communication with said fluid inlet passageway;

e) a rotatable circular distributor disk which rests on said circular base and through which said non-rotatable spindle extends, wherein said distributor disk is located, with respect to said non-rotatable spindle, at the location wherein said one or more inlet ports are positioned through said solid cylindrical wall of said non-rotatable spindle and wherein said distributor disk contains a plurality of drive surfaces that are positioned to receive liquid flowing through said inlet ports, thereby providing a third source of rotation for said rotatable cylindrical chamber;

f) a plurality of vertically spaced frusto-conical shaped disk separators positioned as a stack about said spindle, which stack rests on a frusto-conical shaped cover plate located on top of said distributor disk, which said stack of said disk separators reaches upward toward the top of said cylindrical chamber, wherein each disk separator contains a top surface and an underneath surface, wherein the underneath surface of each of said disk separators contains a plurality of radially positioned raised curved drive surfaces, the thickness of which establishes a predetermined gap between adjacent disk separators, which gap is capable of allowing the passage of upward flowing liquid containing contaminants from said circular distributor disk thereby representing a fourth source of rotation to said rotatable cylindrical chamber when impacted by liquid flowing from the bottom of said rotatable cylindrical chamber and upward through said predetermined gaps between adjacent disk separators to a sub-chamber located at said upper region of said cylindrical chamber; as well as directing a portion of said upward flowing liquid containing contaminants against the inner wall of said cylindrical chamber, thereby forming a sludge build-up on said rotatable cylindrical chamber inner wall;

g) an upper region of said rotatable cylindrical chamber containing a circular cover within which there is provided a cylindrical sub-chamber, which cylindrical sub-chamber contains a rotatable plate having a plurality of curved drive surfaces, which when contacted by exiting fluid from said cylindrical chamber, represents a fifth source of rotational force to said rotatable cylindrical chamber, and wherein there is also provided at least one exit port capable of allowing fluid to exit said separator;

h) a sensor for sensing the rotational speed of said rotatable cylindrical chamber, which sensor is comprised of a first part secured to a non-rotating part of said separator, and a second part secured to a rotatable part of said separator, wherein said sensor is capable of triggering an alarm when the rotational speed of said cylindrical chamber is reduced to a predetermined threshold speed indicating that said separator needs to be serviced; and i) a mesh component, having a porosity, and capable of preventing at least a portion of any contaminants remaining in said exiting fluid from said rotatable cylindrical chamber, which mesh component is located at at least one of said exit ports so that exiting fluid must pass through said mesh component prior to exiting said separator, which mesh component being capable of becoming progressively blocked overtime with contaminants from said exiting fluid, thereby decreasing the porosity of said mesh component, thus resulting in reducing the rotational speed of said cylindrical chamber over time.

2. The separator as claimed in claim 1 in which a predetermined threshold speed of said rotatable cylindrical chamber is indicative of a predetermined thickness of sludge having accumulated on the inner wall of said cylindrical chamber.

3. The separator as claimed in claim 1 in which every said drive surface of said separator is curved or of varying gradient, or multi-radiused, when viewed in plan.

4. The separator as claimed in claim 1 in which every said drive surface of said separator is circumferentially spaced at substantially equal regular angular intervals.

5. The separator as claimed in claim 1 in which every said drive surface of said separator is radially spaced from the axis of rotation of said rotatable cylindrical chamber.

6. The separator as claimed in claim 1 in which at least one outlet is in fluid communication with multiple said drive surfaces that are arranged to be impacted by liquid exiting said separator to provide a rotational force to said rotatable cylindrical chamber.

7. The separator of claim 1 wherein the non-rotating part of said separator to which said first part of said sensor is secured is the spindle.

8. The separator of claim 7 wherein the rotatable part of said separator to which said second part of said sensor is secured is said cylindrical chamber.

* * * * *